US006122389A

United States Patent [19]

Grosz

[11] Patent Number: 6,122,389

[45] Date of Patent: Sep. 19, 2000

[54] FLUSH MOUNTED DIRECTIONAL MICROPHONE

[75] Inventor: Steven R. Grosz, Kenosha, Wis.

[73] Assignee: Shure Incorporated, Evanston, Ill.

[21] Appl. No.: 09/009,148

[22] Filed: Jan. 20, 1998

[51] Int. Cl.[7] ..... A04R 25/00

[52] U.S. Cl. ..... 381/361; 381/338; 381/353; 381/355

[58] Field of Search ..... 381/355, 356, 381/357, 359, 360, 368

[56] References Cited

U.S. PATENT DOCUMENTS

| | | | |
|---|---|---|---|
| 3,787,641 | 1/1974 | Santori | 179/107 BC |
| 4,208,737 | 6/1980 | Thompson et al. | 367/171 |
| 4,381,831 | 5/1983 | Putnam | 181/152 |
| 4,584,702 | 4/1986 | Walker, Jr. . | |
| 4,773,091 | 9/1988 | Busche et al. . | |
| 4,850,016 | 7/1989 | Groves et al. . | |
| 4,965,775 | 10/1990 | Elko et al. . | |
| 5,226,076 | 7/1993 | Baumhauer, Jr. et al. | 379/388 |
| 5,268,965 | 12/1993 | Badie et al. . | |
| 5,511,130 | 4/1996 | Bartlett et al. . | |
| 5,627,901 | 5/1997 | Josephson et al. | 381/155 |
| 5,651,074 | 7/1997 | Baumhauer, Jr. et al. . | |

*Primary Examiner*—Curtis A. Kuntz
*Assistant Examiner*—Dionne N. Harvey
*Attorney, Agent, or Firm*—Banner & Witcoff, Ltd.

[57] ABSTRACT

A unidirectional microphone element can be embedded within an object and be made flush to the object's surface yet retain its directional discrimination characteristic. Acoustic waveguides transmit acoustic input signals from acoustic ports to the front and rear input ports of the microphone element while also providing intelligibility-enhancing frequency response shaping. The housing wherein the microphone element is mounted acoustically isolates the front and rear input ports of the microphone element.

18 Claims, 8 Drawing Sheets

POLAR CHARACTERISTICS

POLAR CHARACTERISTICS

FLUSH MOUNTED DIRECTIONAL MICROPHONE

BACKGROUND OF THE INVENTION

This invention relates to microphones. In particular, this invention relates to directional microphones for use in applications where the microphone is preferably inconspicuous or unobtrusive.

Directional microphones are widely utilized in communications devices for the purpose of increasing signal-to-noise levels and enhancing speech intelligibility. Directional microphones offer discrimination against background noise and undesired acoustic signals originating from directions other than that of the primary receiving lobe of the microphone. As is well known in the art, a first-order directional (or "gradient") microphone element consists of two acoustic input ports used to sense the spatial pressure derivative, dp/dx, of a sound pressure field and produce an output signal proportional to this pressure differential. For unidirectional microphone elements, standard convention defines the "front" entry port to be facing in the direction of maximum sensitivity and the "rear" entry port to be facing in the direction of maximum rejection.

Many applications either require or benefit from flush-mounting or imbedding a microphone in a surface or object. The flush-mounting of an omnidirectional microphone element in a surface is relatively straightforward given the presence of only a single acoustic entry port. For this application, the main design consideration is the pressure enhancing effect of the mounting baffle, which reaches its maximum value of 6 dB (i.e., pressure doubling) at those frequencies for which the baffle size is sufficiently large relative to wavelength. Also well known in the art is the use of acoustic circuits (i.e., cavities and waveguides appropriately dimensioned for a given application bandwidth) for imbedding an omnidirectional element substantially beneath the surface of an object. Such configurations typically call for the consideration and control of waveguide resonances (e.g., the quarter-wavelength resonance of a rigidly terminated waveguide) or perhaps Helmholtz resonances (e.g., those resulting from combination cavity/waveguide input configurations).

In the case of directional microphones, however, flush-mounting or imbedding a microphone element is considerably more challenging for several reasons: 1) the directional microphone requirement for at least two acoustic input ports; 2) the typical locations of front and rear/side entries on commercially available directional microphone elements; 3) the geometry and size limitations imposed by typical application bandwidths; and 4) the critical relative phase and magnitude relationship that must be preserved between the pressure disturbances sensed at each acoustic entry port.

While several imbedded first-order gradient microphone designs have been specifically geared to close-talk telephonic applications, e.g. U.S. Pat. Nos. 4,584,702 to Walker; 4,773,091 to Busche et al.; 4,850,016 to Groves et al., less attention has been given to hands-free applications such as those found in the automotive and computer environments for which the source-to-receiver distance is significantly larger. U.S. Pat. No. 5,627,901 to Josephson et al discloses a first-order gradient microphone imbedded in the center of the upper front edge of a computer monitor intended specifically for hands-free use. This microphone mounting method requires two adjacent orthogonal surfaces and, in lieu of an acoustic circuit, employs a foam-filled cavity with front and rear entry grilles formed into the surface of the monitor. In another notable design, U.S. Pat. No. 5,511,130 to Bartlett et al. has disclosed a second-order gradient microphone consisting of four entry ports and intended for close-talk use in telephone handsets. An unfortunate drawback to the second-order circuit design (relative to a first-order design) is the requirement for front and rear cavities which results in the introduction of Helmholtz resonances due to the interaction of the cavities with the entry ports. In addition, the narrower main lobe and reduced low frequency response (certainly appropriate for close-talk applications in which the proximity effect is inherently present) are not necessarily desirable for hands-free applications.

SUMMARY OF THE INVENTION

A directional microphone comprised of a unidirectional microphone element having front and rear acoustic inputs can be flush-mounted to a surface while preserving (or modifying if desired) the free field directional characteristics of the element. The unidirectional element is mounted in a housing that is formed with two included waveguides which conduct acoustic energy from a surface into the housing where the unidirectional element is mounted. A first waveguide carries acoustic signals to the unidirectional element's first, or front, acoustic input port; a second waveguide carries acoustic signals to the unidirectional element's second, or rear, acoustic input port. In addition to providing intelligibility enhancing frequency response shaping, the waveguides effectively couple what would be considered front and rear acoustic signals to the element's front and rear acoustic inputs and permit acoustic signals to be carried to the unidirectional element even when the element is embedded in an object. The result is a reasonably simple flush-mountable package that delivers a desired directional selectivity while eliminating comb-filtering and enhancing intelligibility.

DETAILED DESCRIPTION OF THE PREFERRED EMBODIMENT

Figure 1:
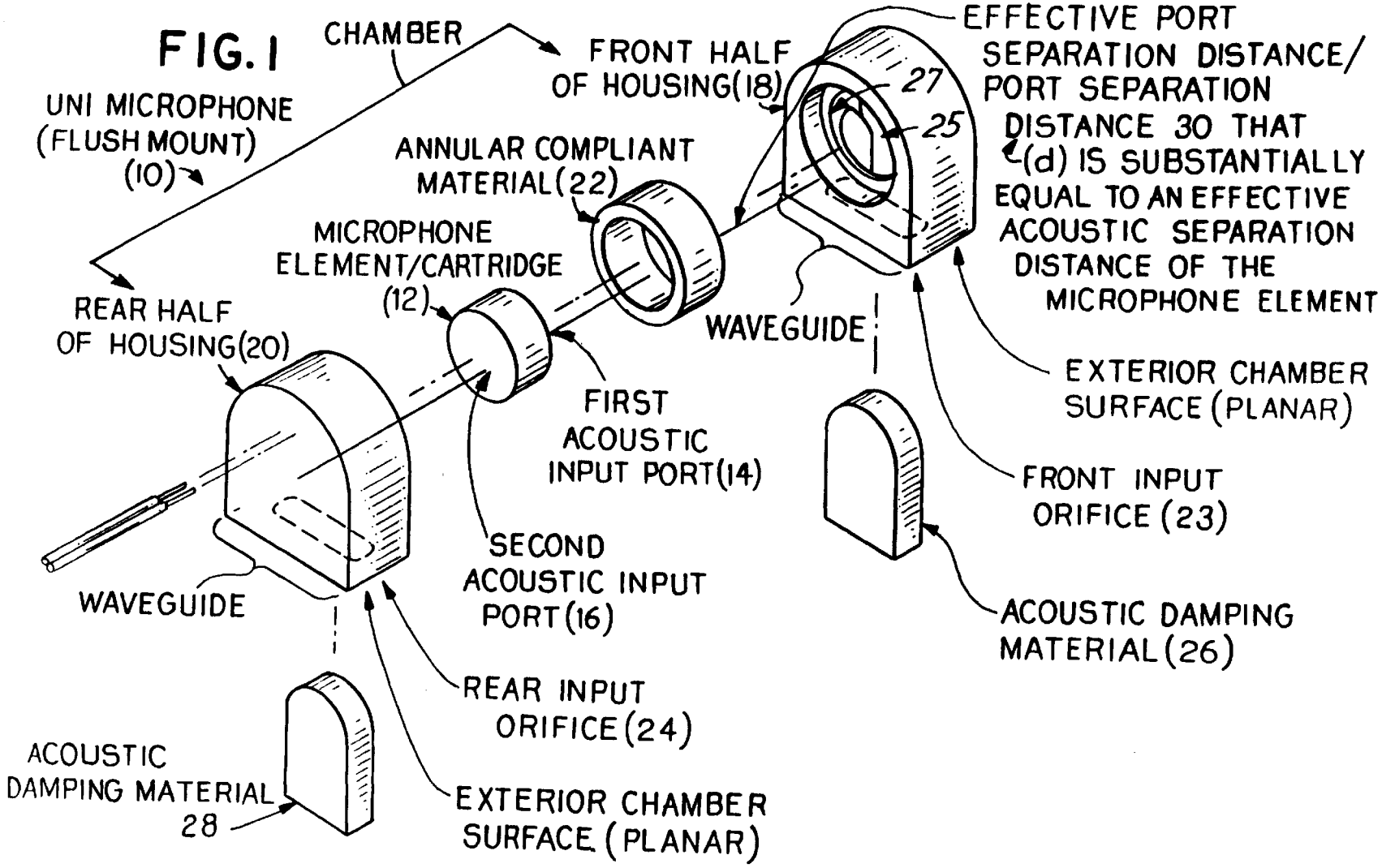
FIG. 1 is an exploded perspective view of a unidirectional, flush-mountable microphone.

FIG. 1 shows an exploded perspective view of a unidirectional, flush-mountable microphone (10). The microphone (10) is comprised of a well known, unidirectional microphone element (12) having two acoustic input ports (14, 16). The unidirectional microphone element is also known as a first-order gradient microphone in the art. Although the preferred embodiment utilizes an electret condenser microphone element, other transducer types can be substituted into the design.

The two acoustic ports (14, 16) receive acoustic pressures present in the ambient environment. The microphone element (12) produces an electrically measurable signal at an output port (not shown) which is proportional to the spatial derivative of acoustic pressure as measured between the first and second acoustic input ports (14,16). The characteristics of directional (i.e., cardioid, supercardioid, hypercardioid, and bidirectional) microphone elements are well known prior art. A directional microphone element possesses an internal acoustic phase shift network which is specifically tailored to the phase shift that results from the effective acoustic path length difference between the front and rear entry ports. This internal acoustic network is appropriately tuned so as to achieve zero diaphragm velocity, or a response null, for a specified incidence angle (e.g., 180 degrees for a cardioid).

The two input ports (14, 16) of the cardioid microphone element (12) shown in FIG. 1 are separated by a known, predetermined distance. The chamber which houses the microphone element is comprised of two halves (18, 20). Each of the two halves of the housing (18, 20) has an interior pocket shaped so as to substantially conform to the shape of the microphone element (12). An annular compliant material (22) surrounding the microphone element (12) allows for a secure pressure fit installation of the microphone element (12) into the mating portions of the housing halves (18, 20) and also provides acoustic isolation between the two input ports (14, 16) once assembled. In the preferred embodiment, the annular compliant material (22) does not serve as a mechanical shock mount. For applications requiring vibration isolation, this component can be replaced by a more compliant supporting structure so long as the acoustic isolation between the input ports (14, 16) is preserved.

Figure 2:
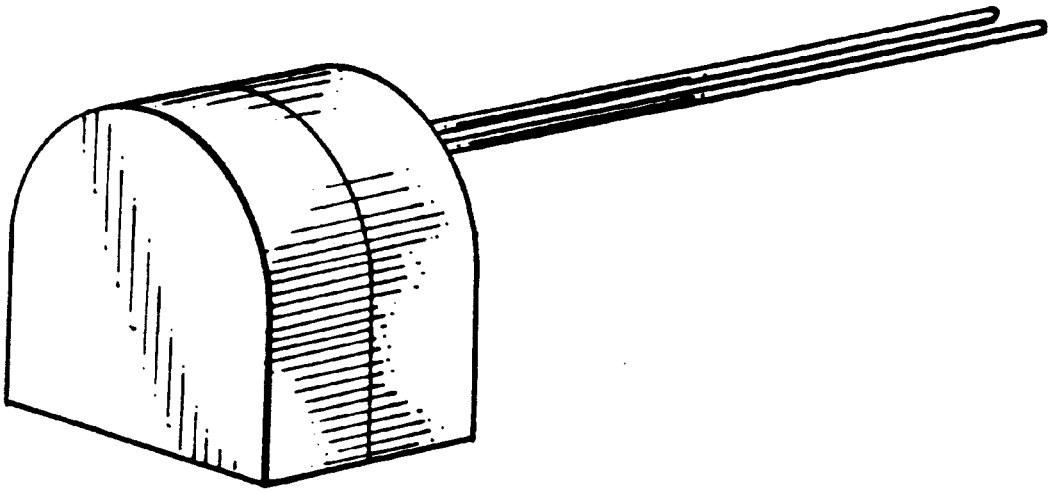
FIG. 2 is an assembled view of the microphone shown in FIG. 1.

The two halves of the housing (18, 20) are formed to include acoustic waveguides. The front half of the housing (18) has an input orifice (23) as shown. The interior volume forming the waveguide maintains a constant cross-section until tapering into a radiused termination at the element end of the waveguide. At this end of the waveguide is a cylindrically-shaped volume (25) having an inside diameter greater than that of the waveguide so as to form a retention ridge (27) in the housing (18) against which the annular compliant material (22) rests when the two housing halves (18, 20) are assembled as shown in FIG. 2. The axial length of the annular compliant piece (22) is made slightly larger than that of the microphone element (12) so as to insure that the element housing (12) does not contact or rattle against the waveguide housing (18). In the preferred embodiment, the housing (18, 20) material is plastic and the annular compliant material (22) is neoprene.

The rear half of the housing (20) is identically shaped so as to carry acoustic signals to the rear input port (14) of the microphone element (12). The interior of the rear half of the housing (20) is not visible in FIG. 1, which is a perspective view of the exploded housing. Note that the only dissimilarity between the front housing (18) and the rear housing (20) is the presence of two sealed cable exit holes in the rear housing (20) which are required to pass the electrical output signal from the microphone element (12) to external electronics.

For the microphone element (12) in free field, the external spatial phase shift is a function of theta in the dissecting plane which lies orthogonal to the front and rear surfaces of the element housing (12). For the flush-mountable microphone assembly (10), the spatial phase shift is instead a function of theta in the plane in which the waveguide port openings (23, 24) are flush-mounted. If it is desired to maintain the original directional characteristics of the microphone element (12), as is the case with the preferred embodiment, the center-to-center port spacing is to be approximately equivalent to the effective acoustic path length between the front and rear entry ports (14, 16) of the directional microphone element (12). Note that the effective acoustic path length is not necessarily equivalent to the geometric separation distance. Alternative directional tune-ups can be achieved through manipulation of the port spacing distance with proper consideration of the impact of geometry changes on system resonances.

The acoustic circuit contained within the housings (18, 20) makes possible the flush mounting of the microphone (10) in a baffle without sacrificing the directional polar response of the microphone (10) in the half-space external to the baffle. In addition to the obvious aesthetic benefits, the flush mounting also serves to eliminate comb-filtering effects that plague many boundary-based microphones, and such a mounting scheme inherently offers a decreased sensitivity to airflow-induced noise and distortion due to its low turbulence "profile" in the mounting surface.

Figure 3:
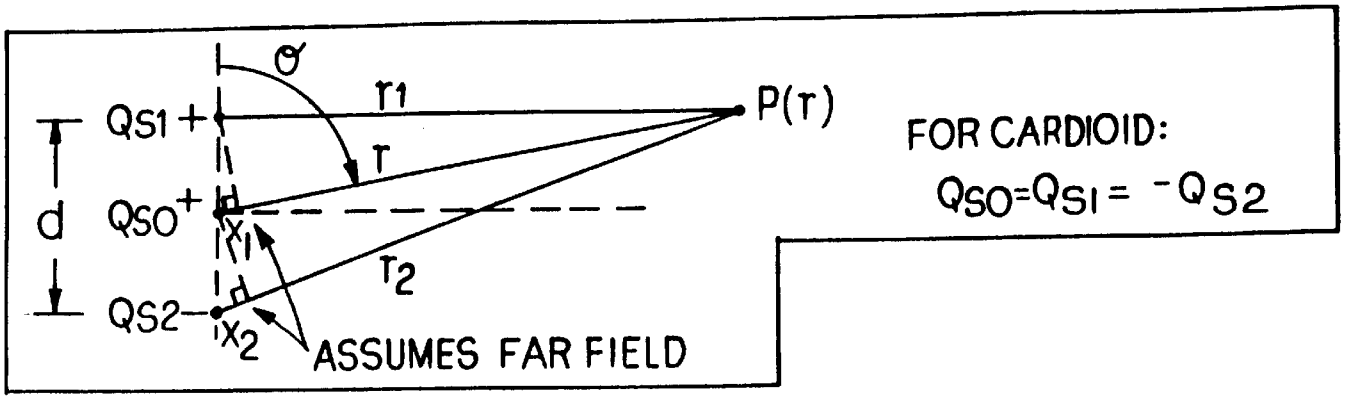
FIG. 3 depicts the point source/receiver equivalent of a cardioid source/receiver.

Assume that the unidirectional microphone has a cardioid polar response. From acoustic theory, the point source (or receiver by reciprocity) equivalent of a cardioid can be represented by a dipole pair with a monopole located at the dipole origin as depicted in FIG. 3. Assuming far field conditions (i.e., source-to-receiver spacing much greater than the dipole spacing) and dipole dimensions that are small compared to wavelength, the normalized directivity function of the cardioid array is well known in the art as: $0.5*(1+\cos\theta)$. With the cardioid directivity function defined, the effect of the baffle on polar response and frequency response can be investigated.

Figure 4:
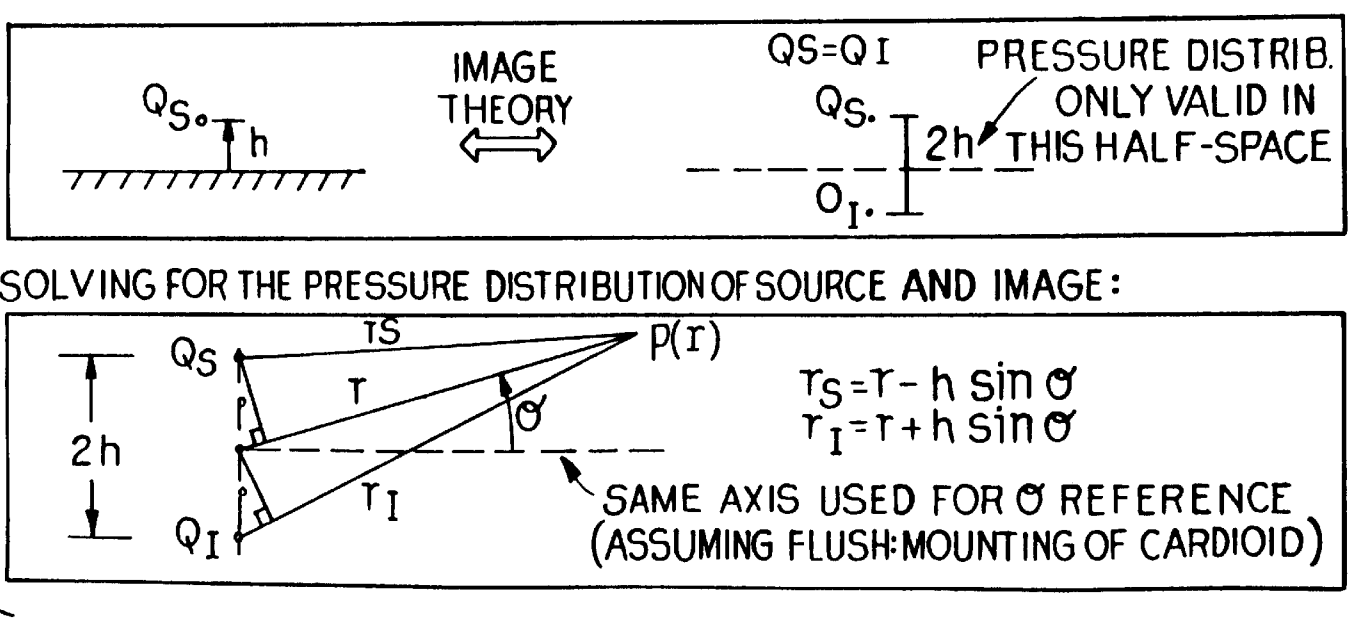
FIG. 4 depicts the image theory representation of a point source located near a reflective boundary.

Utilizing image theory as depicted in FIG. 4 and again assuming far field conditions, the complex pressure distribution of a point source located a distance h from an infinitely large reflective plane can be calculated to be:

$$p(r) = \frac{A}{r_s} Q_s e^{-jkr_s} + \frac{A}{r_i} Q_i e^{-jkr_i} = \frac{AQ_s}{r} \cos\left(\frac{2\pi h}{\lambda} \sin\theta\right)$$

where:

A is a magnitude scaling factor;

$\lambda$ is the excitation wavelength;

$Q_s$ is the source strength;

$Q_i$ is the image source strength;

$r_s$ is the source-to-receiver distance;

$r_i$ is the image-to-receiver distance;

r is the distance from the receiver to the midpoint between the source and image;

k is the wavenumber;

h is the separation distance between the source and the reflective plane.

From inspection of the above equation, the directivity function is given by the expression, $\cos[(2\pi h/\lambda)\sin\theta]$, and comb-filtering nulls will therefore occur at all frequencies for which the separation distance, h, is equal to an odd multiple of quarter wavelengths (or expressed mathematically, for $h=\lambda/4, 3\lambda/4, 5\lambda/4 \ldots$). For a truly flush-mounted source (or receiver by reciprocity), the separation distance h is equal to zero and the directivity function will be equal to unity for all frequencies and all values of theta. Thus, the theoretical frequency response of the flush-mounted microphone is free of all comb-filtering artifacts.

Figure 5:
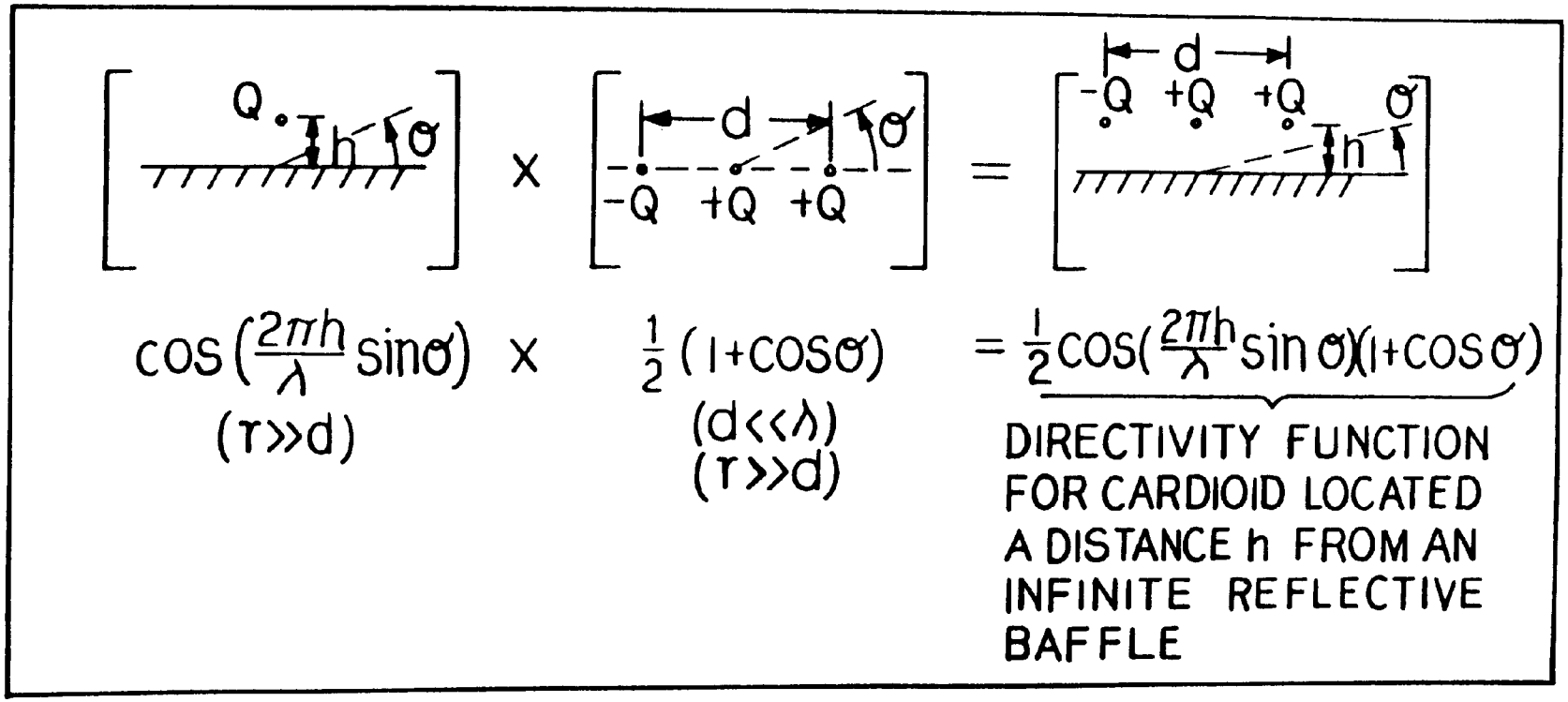
FIG. 5 depicts the First Product Theorem representation of a cardioid array located near a reflective boundary.

Referring to FIG. 5, the First Product Theorem can be used to determine the effect of flush mounting on the far field polar response of the cardioid array. By multiplying the directivity function of a point source located a distance h from an infinitely reflective baffle by the directivity function of a properly oriented cardioid array, the directivity function is yielded for a cardioid array located a distance h from an infinitely reflective baffle:

$$\frac{1}{2}\cos\left(\frac{2\pi h}{\lambda}\sin\theta\right)(1+\cos\theta).$$

From the above directivity function, it can be seen that for a flush-mounted cardioid (i.e., h=0), the resulting polar response in the half-space external to the baffle reduces to that of the cardioid in free field. Thus, the microphone functions as a first-order unidirectional microphone as effectively in flush-mounted conditions as under free field conditions.

Given the geometry dictated by the flush-mounting requirement in addition to the one centimeter diameter of the microphone element (12) used in the preferred embodiment, the required waveguide length does not allow for lumped-element treatment of the waveguide acoustic impedance. Using the lumped-element constraint of $l<\lambda/16$ as suggested by Beranek in *Acoustics*, published by the American Institute of Physics, (copr. 1954, 1986), the length limitations for the desired bandwidth limit of 10 kHz and the minimum required bandwidth of 3 kHz correspond to 0.08" and 0.28", respectively. Because the preferred embodiment geometry does not allow for waveguide lengths within these limits, the waveguides are treated instead as rigidly terminated acoustic transmission lines with input impedance defined as follows:

$$Z_\epsilon = \frac{\rho_o c}{jS\tan(2\pi L/\lambda)}$$

where $\rho_o$ is the density of air, c is the speed of sound in air, S is the cross-sectional area of the waveguide, L is the waveguide length, and $\lambda$ is the excitation wavelength. For this impedance expression to be valid, the cross-sectional dimensions of the waveguide must be small enough so as to prevent the onset of cross-mode propagation in the waveguide. Using the cross-sectional constraint of $d<\lambda/6$ as suggested by Beranek, supra. the cross-dimensional limitations for the desired bandwidth limit of 10 kHz and the minimum required bandwidth of 3 kHz correspond to 0.23" and 0.75" respectively. The waveguide cross-section must be maintained within the limits dictated by the desired bandwidth.

Although less straightforward than the lumped-element design alternative, the transmission line treatment of the input waveguides allows for a significant design advantage to be incorporated into the microphone (10). Inspecting the waveguide input impedance equation, it is found that resonance will occur for the condition, $\cos(2\pi L/\lambda)=0$, or equivalently stated, at those frequencies for which the waveguide length is equal to an odd multiple of quarter-wavelengths. Through appropriate selection of waveguide length, the designer can utilize this resonance mechanism to provide a presence peak in the microphone frequency response. The use of such presence peaks is well known in the art to be of importance in increasing intelligibility for communications applications. In the preferred embodiment, the waveguide length of 0.660" was chosen to provide a theoretical fundamental resonance frequency of 4.8 kHz with end corrections having been taken into account. The resonance can be shifted lower or higher in frequency through the lengthening or shortening, respectively, of the waveguide length. Both waveguides are preferably acoustically symmetric, tuned to a common fundamental resonance, and filled with equal amounts of acoustic damping material (26, 28) so as to reduce the resonance peak to an appropriate level. In the preferred embodiment the damping material (26, 28) is Scottfelt ⅛-3-650 foam.

Figure 6:
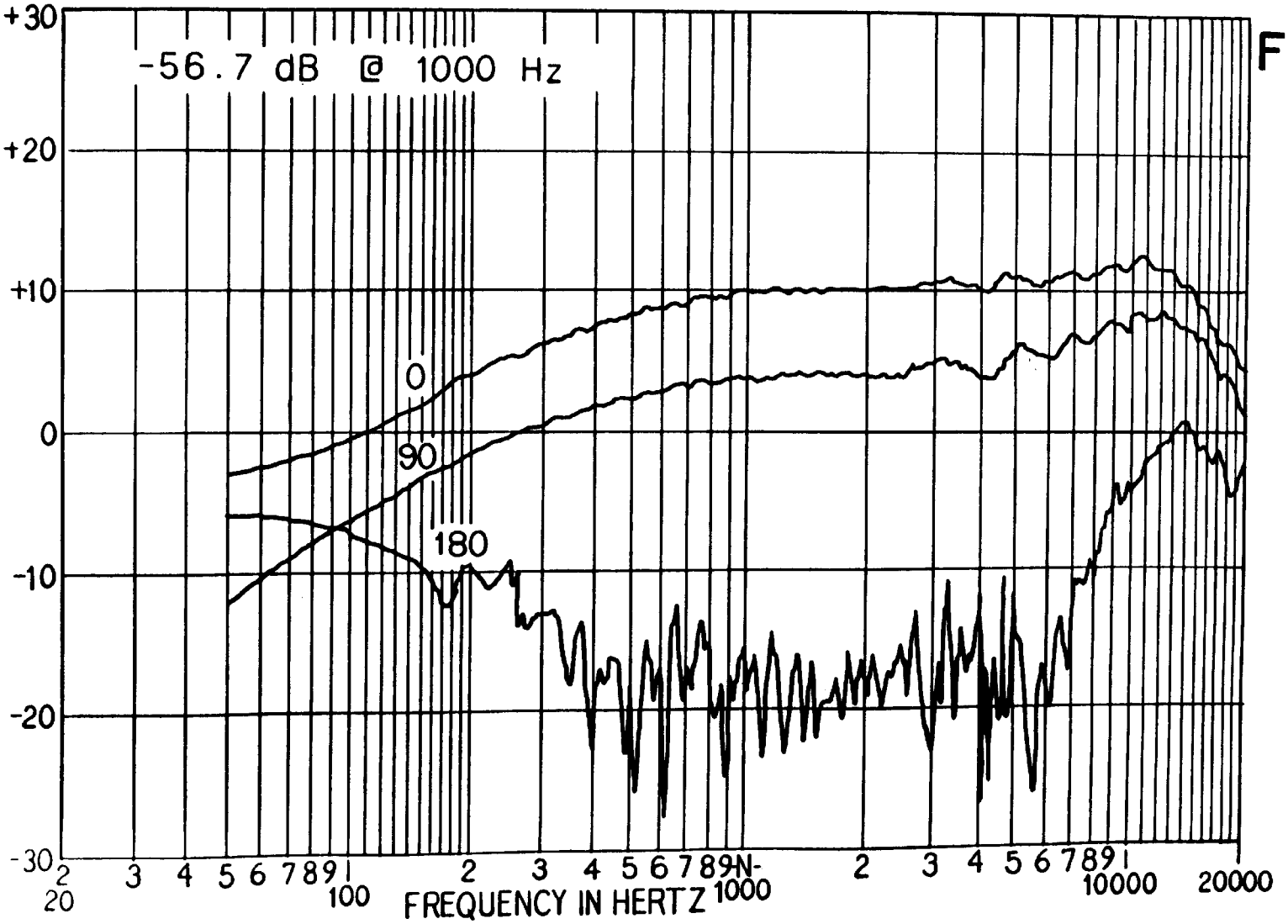
FIG. 6 is the frequency response of the unidirectional microphone element that is built into the prototype unit (as measured in an anechoic environment).
Figure 7:
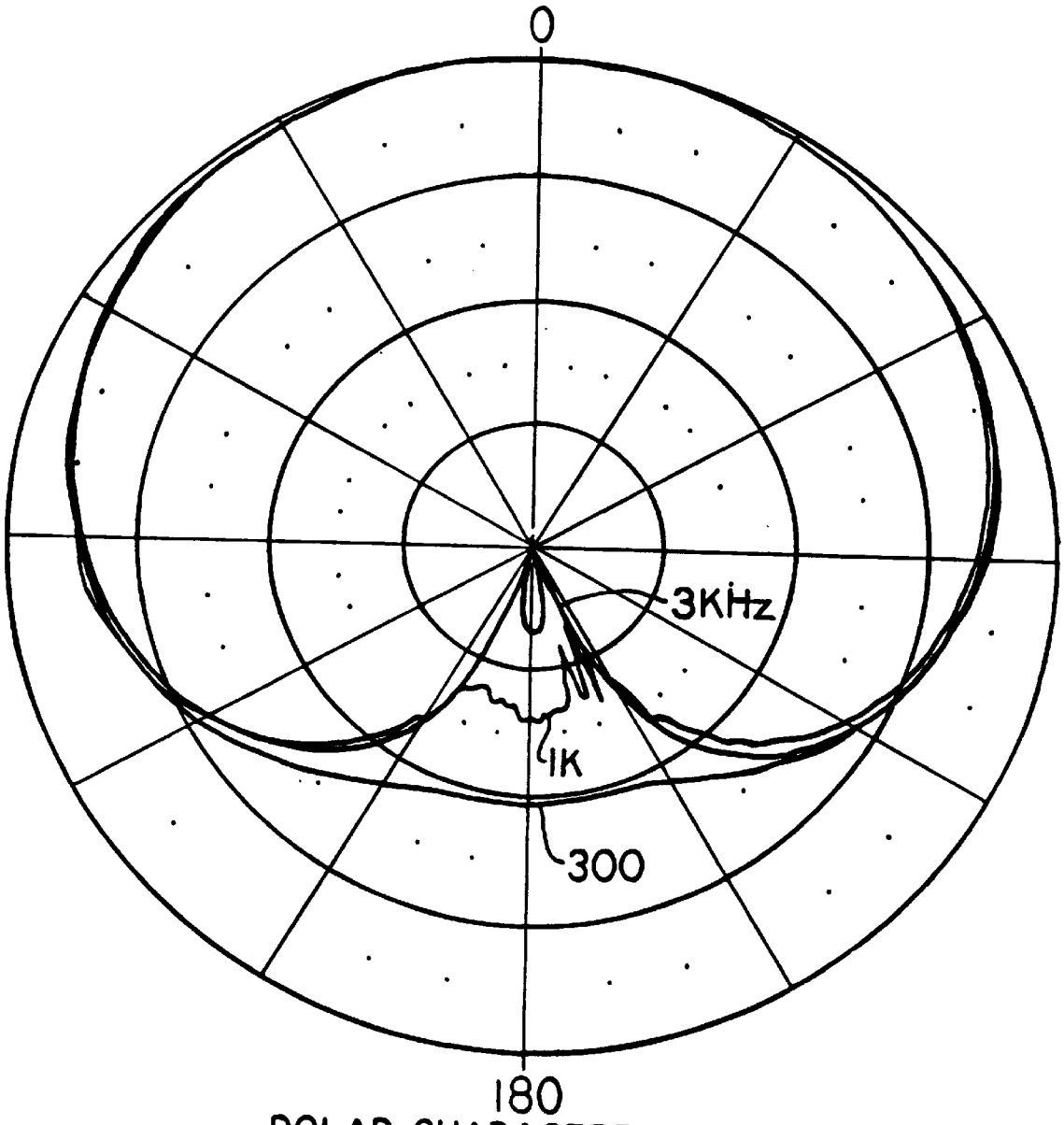
FIG. 7 is the polar response of the unidirectional microphone element that is built into the prototype unit (as measured in an anechoic environment).
Figure 8:
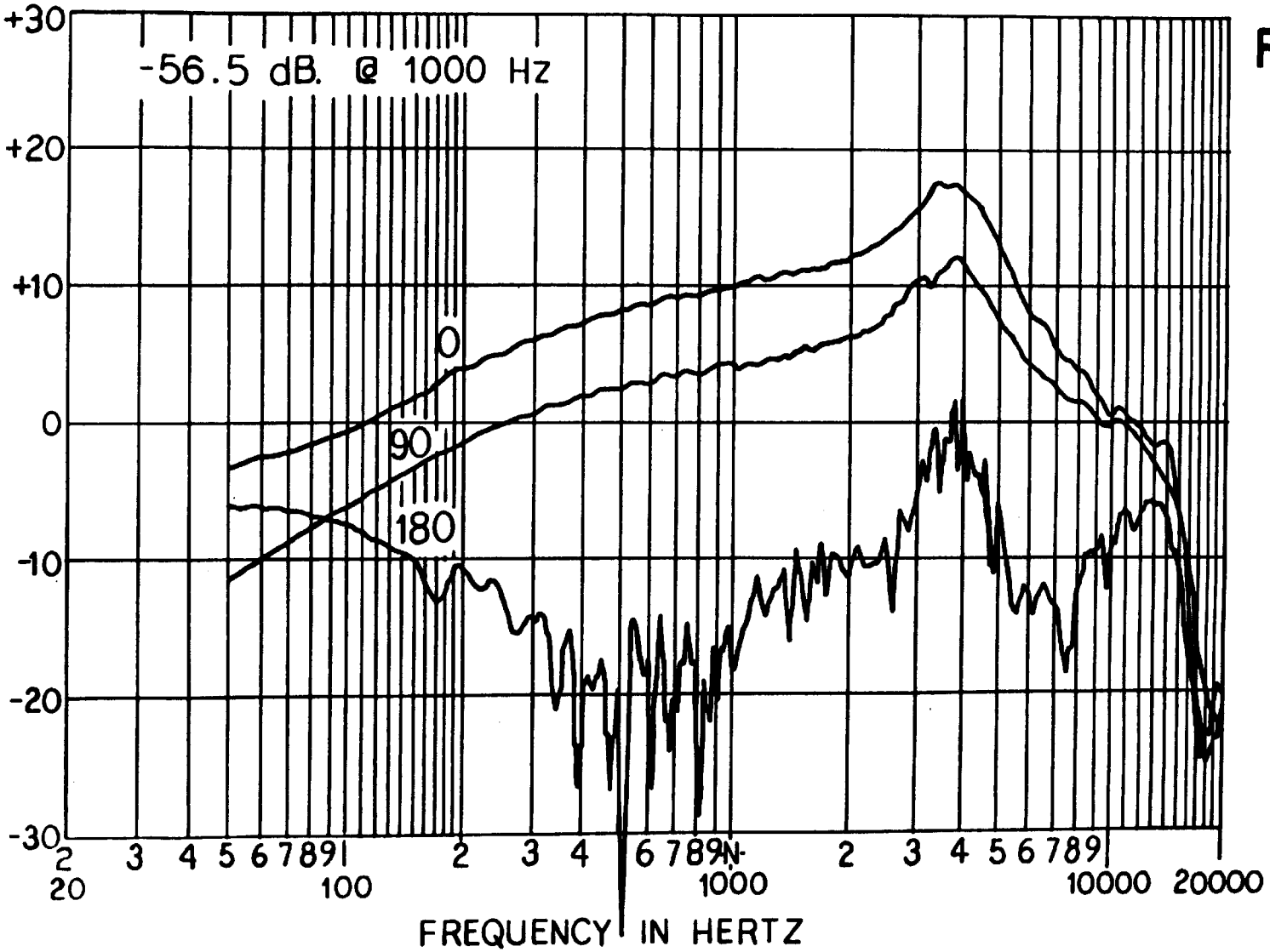
FIG. 8 is the frequency response of the assembled unidirectional microphone prototype unit (as measured in an anechoic environment).
Figure 9:
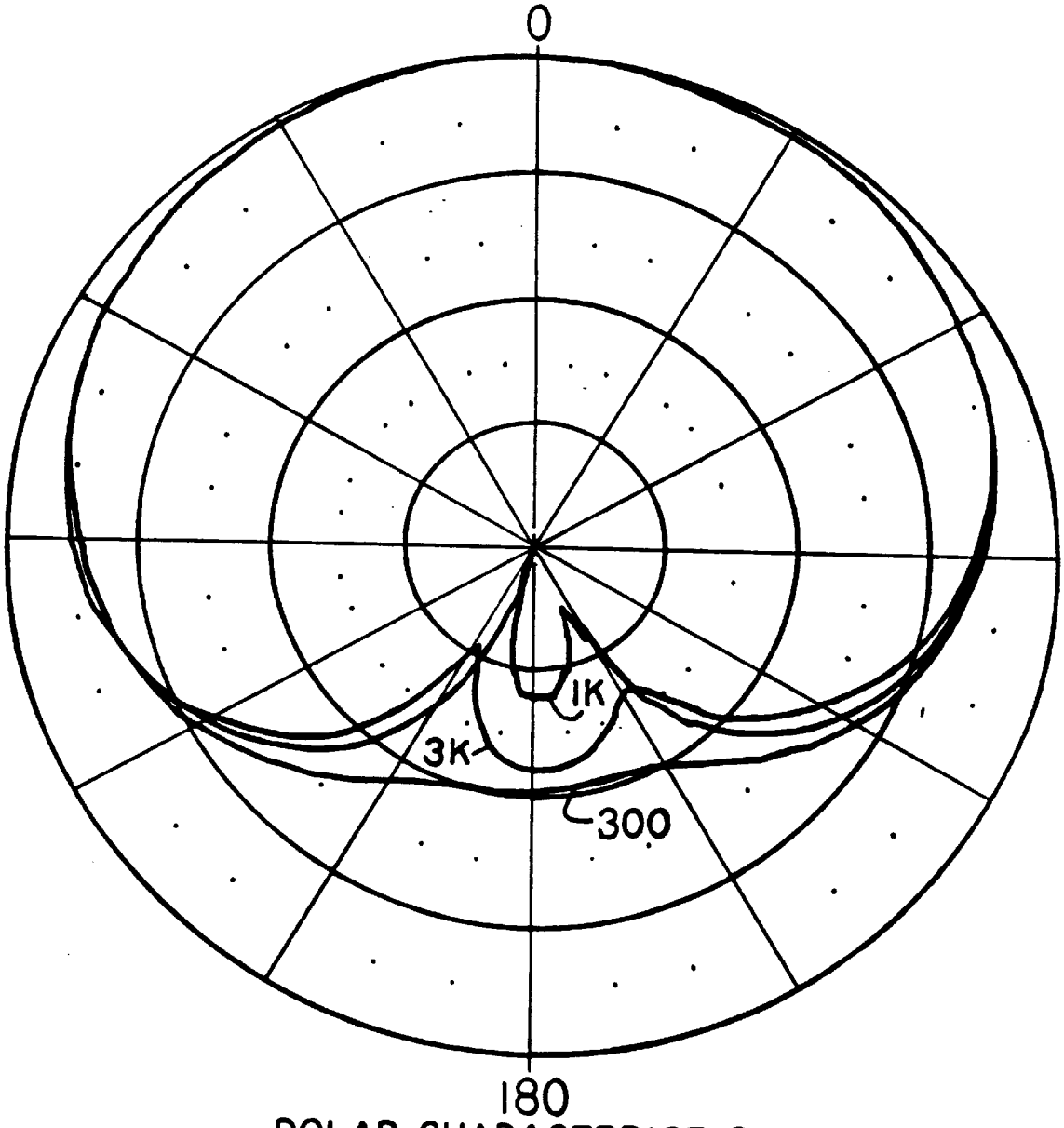
FIG. 9 is the polar response of the assembled unidirectional microphone prototype unit (as measured in an anechoic environment).

FIG. 6 and FIG. 7 depict the frequency response and polar response, respectively, of the unidirectional microphone element (12) used in the preferred embodiment. FIG. 8 and FIG. 9 depict the frequency response and polar response, respectively, of the microphone element (12) once installed in the housing (18, 20) of the preferred embodiment.

The front and rear input orifices (23, 24) are of rectangular cross-sectional shape. The major diameter of the preferred embodiment orifices (23, 24) measures 0.384", sufficiently below the cross-dimensional limit to prevent cross-mode propagation well beyond 3 kHz. The minor diameter is oriented along the same axis as the effective port separation distance, d. Such orientation of the minor diameter allows for a clearly defined value of d, which is of critical importance in determining the directivity characteristics of the microphone (10).

In FIG. 1, the microphone housing (18, 20) is preferably molded to have at least one planar exterior surface through which the acoustic waveguides extend. By forming the housing (18, 20) with at least one exterior planar surface, the microphone (10) can be installed in objects (not shown) having planar surfaces. The microphone (10) can be mounted within such an object yet be nearly unobservable by virtue of the fact that the microphone's input ports are planar and can be mounted flush to a planar surface. As shown in FIG. 10, the microphone (10) might be mounted in an automobile headliner or dashboard. One of the entry ports (23,24) of the housing corresponds to a front acoustic input; the other a rear acoustic input. The housing might be rotated, before or after installation, to change the direction and orientation of the front acoustic input port so as to conform to a talker's location or other application-specific factors. The microphone might also be used in other flat surfaces, including but not limited to desks, conference tables, computer monitors, and so forth.

What is claimed is:

1. A directional microphone, capable of being mounted flush to a surface of an object, comprised of:

i) a microphone element having first and second acoustic input ports, said microphone element producing an electrical signal at an electrical output port;

ii) a chamber, comprising two rigid halves of a housing, receiving said microphone element and acoustically separating said first acoustic input port substantially from said second acoustic input port, said chamber further comprising a first acoustic waveguide having a first acoustic input orifice coupling said first acoustic input port of said first-order gradient microphone element to said surface, a second acoustic waveguide having a second acoustic input orifice, coupling said second acoustic input of said first-order gradient microphone element to said surface, wherein a port separation distance is substantially equal to an effective acoustic separation distance of the microphone element and wherein said first acoustical waveguide and said second acoustical waveguide have substantially equal predetermined acoustic lengths, and wherein said first and second waveguides include means for providing substantially equal acoustical damping of a fundamental waveguide resonance, with the front input orifice of the first acoustic waveguide and the rear input orifice of the second acoustic waveguide being arranged on a planar exterior surface with each waveguide having substantially equal amounts of acoustic damping material, each said amount of acoustic damping material being arranged in a shape to fit inside the front housing and the rear housing such that a resonance peak is reduced to an appropriate level.

2. The apparatus of claim 1 where said chamber further includes an exterior chamber surface through which both said first and second acoustic waveguides extend.

3. The apparatus of claim 1 where said chamber includes at least one planar exterior chamber surface through which both said acoustic waveguides extend.

4. The apparatus of claim 1 where said unidirectional microphone element is a cardioid microphone element.

5. The apparatus of claim 1 where said first acoustic input orifice and said second acoustic input orifice are substantially coplanar.

6. A directional microphone, capable of being mounted flush to a surface of an object, comprised of:

i) a first-order gradient microphone element having first and second acoustic input ports receiving acoustic pressures at said first and second acoustic input ports, said microphone element producing an electrical signal at an electrical output port proportional to the acoustic pressure difference between said first and second acoustic input ports, said first and second acoustic energy input ports separated by a predetermined distance;

ii) a chamber, comprising two rigid halves of a housing, receiving said first-order gradient microphone element and acoustically separating said first acoustic input port from said second acoustic input port, said chamber further comprising a first acoustic waveguide having a first acoustic input orifice coupling said first acoustic input port of said first-order gradient microphone element to said surface, a second acoustic waveguide having a second acoustic input orifice, coupling said second acoustic input port of said first-order gradient microphone element to said surface, wherein a port separation distance is substantially equal to an effective acoustic separation distance of the microphone element, wherein said first acoustic waveguide and said second acoustic waveguide have substantially equal predetermined acoustic lengths, and wherein said first and second waveguides include means for providing substantially equal acoustical damping of a fundamental waveguide resonance, with the front input orifice of the first acoustic waveguide and the rear input orifice of the second acoustic waveguide being arranged on a planar exterior surface with each waveguide having substantially equal amounts of acoustic damping material, each said amount of acoustic damping material being arranged in a shape to fit inside the front housing and the rear housing such that a resonance peak is reduced to an appropriate level.

7. The apparatus of claim 6 where said chamber further includes an exterior chamber surface through which both said first and second acoustic waveguides extend.

8. The apparatus of claim 6 where said chamber includes at least one planar exterior chamber surface through which both said acoustic waveguides extend.

9. The apparatus of claim 6 where said unidirectional microphone element is a cardioid microphone element.

10. The apparatus of claim 6 where said first acoustic input orifice and said second acoustic input orifice are substantially coplanar.

11. A directional microphone, mounted within an object having a surface, said directional microphone being mounted substantially flush to said surface and comprising:

i) a first-order gradient microphone element having first and second acoustic input ports receiving acoustic pressures at said first and second acoustic input ports, said microphone element producing an electrical signal at an electrical output port proportional to the acoustic pressure difference between said first and second acoustic input ports, said first and second acoustic energy input ports separated by a predetermined distance;

ii) a chamber, comprising two rigid halves of a housing, mounted substantially below said surface of said object and receiving said first-order gradient microphone element, said chamber acoustically separating said first acoustic input port from said second acoustic input port, said chamber further comprising a first acoustic waveguide having a first acoustic input orifice coupling said first acoustic input port of said first-order gradient microphone element to said surface, a second acoustic waveguide having a second acoustic input orifice, coupling said second acoustic input port of said first-order gradient microphone element to said surface;

iii) at least one opening in said surface of said object for passing acoustic signals through to said first order gradient microphone element, wherein a port separation distance is substantially equal to an effective acoustic separation distance of the microphone element, wherein said first acoustic waveguide and said second acoustic waveguide have substantially equal predetermined acoustic lengths, and wherein said first and second waveguides include means for providing substantially equal acoustical damping of a fundamental waveguide resonance, with the front input orifice of the first acoustic waveguide and the rear input orifice of the second acoustic waveguide being arranged on a planar exterior surface with each waveguide having substantially equal amounts of acoustic damping material, each said amount of acoustic damping material being arranged in a shape to fit inside the front housing and the rear housing such that a resonance peak is reduced to an appropriate level.

12. The apparatus of claim 11 where said unidirectional microphone element is a cardioid microphone element.

13. The apparatus of claim 11 where said first acoustic input orifice is separated from said second acoustic input orifice by said predetermined distance on an axis.

14. The apparatus of claim 11 where said first acoustic input orifice and said second acoustic input orifice are substantially coplanar.

15. The apparatus of claim 11 wherein said first orifice is substantially rectangular having a width dimension and a length dimension wherein said length dimension exceeds said width dimension.

16. The apparatus of claim 11 wherein said second orifice is substantially rectangular having a width dimension and a length dimension wherein said length dimension exceeds said width dimension.

17. The apparatus of claim 11 wherein said means for acoustically damping fundamental waveguide resonance is an acoustic foam.

18. The apparatus of claim 17 wherein said acoustic foam is Scottfelt ⅛-3-650 foam.

* * * * *